US011480184B2

(12) United States Patent
Sugiyama et al.

(10) Patent No.: US 11,480,184 B2
(45) Date of Patent: Oct. 25, 2022

(54) HERMETIC COMPRESSOR

(71) Applicant: DAIKIN INDUSTRIES, LTD., Osaka (JP)

(72) Inventors: Toru Sugiyama, Osaka (JP); Tomoko Mizuguchi, Osaka (JP); Souichi Nakamura, Osaka (JP); Eitarou Nakatani, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 289 days.

(21) Appl. No.: 16/640,238

(22) PCT Filed: Jun. 29, 2018

(86) PCT No.: PCT/JP2018/024846
§ 371 (c)(1),
(2) Date: Feb. 19, 2020

(87) PCT Pub. No.: WO2019/039087
PCT Pub. Date: Feb. 28, 2019

(65) Prior Publication Data

US 2020/0248703 A1 Aug. 6, 2020

(30) Foreign Application Priority Data

Aug. 21, 2017 (JP) ..... JP2017-158913

(51) Int. Cl.
*H01R 13/52* (2006.01)
*H01R 13/73* (2006.01)
(Continued)

(52) U.S. Cl.
CPC ..... *F04D 25/0693* (2013.01); *F04B 39/023* (2013.01); *F04B 39/121* (2013.01);
(Continued)

(58) Field of Classification Search
CPC ..... F04B 53/16; F04B 39/121; F04B 39/023; H01R 13/5213; H01R 13/73;
(Continued)

(56) References Cited

U.S. PATENT DOCUMENTS 4,984,973 A 1/1991 Itameri-Kinter et al.
6,755,631 B2 * 6/2004 Kawashima ..... F04B 39/12 417/313

(Continued)

FOREIGN PATENT DOCUMENTS

CN 101666306 A 3/2010
JP 6-185463 A 7/1994

(Continued)

OTHER PUBLICATIONS

International Preliminary Report of corresponding PCT Application No. PCT/JP2018/024846 dated Feb. 27, 2020.

(Continued)

*Primary Examiner* — Christopher S Bobish
(74) *Attorney, Agent, or Firm* — Global IP Counselors, LLP

(57) ABSTRACT

A hermetic compressor includes a compressor shell, a terminal provided on the compressor shell, a terminal guard erected on the compressor shell and surrounding the terminal, and a terminal cover mounted to the terminal guard and covering the terminal. A terminal chamber is defined by the compressor shell, the terminal guard, and the terminal cover. Except for at least a body of the terminal, metal portions facing the terminal chamber are generally covered with an insulator such that the metal portions are not exposed to the terminal chamber. The insulator includes an insulating portion that covers an inner surface of the terminal guard.

8 Claims, 9 Drawing Sheets

(51) Int. Cl.

| | |
|---|---|
| ***F04B 39/12*** | (2006.01) |
| ***F04B 53/16*** | (2006.01) |
| ***F04B 39/02*** | (2006.01) |
| ***F04D 25/06*** | (2006.01) |

(52) U.S. Cl.
CPC ..... *F04B 53/16* (2013.01); *H01R 13/5213* (2013.01); *H01R 13/73* (2013.01); *F04C 2240/30* (2013.01); *F04C 2240/40* (2013.01); *F04C 2240/803* (2013.01)

(58) Field of Classification Search
CPC ..... F04C 2240/30; F04C 2240/40; F04C 2240/803; F04D 25/0693
USPC ..... 417/902
See application file for complete search history.

(56) References Cited

U.S. PATENT DOCUMENTS

| | | | | |
|---|---|---|---|---|
| 7,351,043 | B2 * | 4/2008 | Haller | F01C 21/10 417/410.3 |
| 8,939,735 | B2 * | 1/2015 | Heidecker | H01R 13/6395 417/410.1 |
| 9,331,420 | B2 * | 5/2016 | Bedell | F04C 23/008 |
| 10,485,128 | B2 * | 11/2019 | Trudeau, Jr. | F04C 28/28 |
| 2009/0233498 | A1 * | 9/2009 | Nakajima | F04B 39/121 439/892 |
| 2017/0276136 | A1 * | 9/2017 | Kinoshita | F04B 39/121 |

FOREIGN PATENT DOCUMENTS

| | | | |
|---|---|---|---|
| JP | 2007-146728 | A | 6/2007 |
| JP | 2008-169754 | A | 7/2008 |
| JP | 2015-02-16 | A | 2/2015 |
| JP | 2015-32784 | A | 2/2015 |

OTHER PUBLICATIONS

European Search Report of corresponding EP Application No. 18 84 7682.4 dated May 4, 2020.
International Search Report of corresponding PCT Application No. PCT/JP2018/024846 dated Jul. 16, 2018.

* cited by examiner

1

1

HERMETIC COMPRESSOR

CROSS-REFERENCE TO RELATED APPLICATIONS

This U.S. National stage application claims priority under 35 U.S.C. § 119(a) to Japanese Patent Application No. 2017-158913, filed in Japan on Aug. 21, 2017, the entire contents of which are hereby incorporated herein by reference.

BACKGROUND

Field of the Invention

The present invention relates to a hermetic compressor mounted on an air conditioner or the like, and relates to a hermetic compressor including a terminal protection structure for protecting a terminal protruding outward from a compressor shell.

Background Information

Conventionally, there is a hermetic compressor including a compressor shell, a terminal provided on the compressor shell, a terminal guard erected on the outside of the compressor shell so as to surround the terminal, and a terminal cover mounted to the terminal guard so as to cover the terminal (see, for example, JP 2007-146728 A).

SUMMARY

Incidentally, in the above-described hermetic compressor, when some abnormality occurs and a large current flows to the terminal, there is a risk that insulating glass fixing a terminal rod melts and the terminal rod is detached. The detached terminal rod may be blown away due to the internal pressure of the compressor and collide with an inner wall of a terminal chamber. In such a case, if a metal portion is exposed on the inner wall of the terminal chamber defined by the compressor shell, the terminal guard, and the terminal cover, there is a problem that the terminal rod, which is a live wire, comes into contact with the metal portion and short-circuit occurs, which causes a spark.

Accordingly, an object of the present invention is to provide a hermetic compressor capable of preventing occurrence of a spark by preventing a live wire portion from coming into contact with a metal surface even if a terminal rod comes out.

A hermetic compressor according to one aspect of the present invention includes:

a compressor shell;

a terminal that is provided on the compressor shell;

a terminal guard that is erected on the compressor shell and surrounds the terminal; and a terminal cover that is mounted to the terminal guard and covers the terminal;

in which a terminal chamber is defined by the compressor shell, the terminal guard, and the terminal cover, except for at least a body of the terminal, metal portions facing the terminal chamber are generally covered with an insulator such that the metal portions is not exposed to the terminal chamber side, and the insulator includes an insulating portion that covers an inner surface of the terminal guard.

Here, "generally covered with an insulator such that the metal portions are not exposed to the terminal chamber" means that, for example, except for the body of the terminal, the metal portions facing the terminal chamber may be completely covered with the insulator, or the metal portions facing the terminal chamber may be covered with an insulator having a gap that does not allow the terminal rod to enter therein.

According to the above-described configuration, except for at least the body of the terminal, the metal portions facing the terminal chamber defined by the compressor shell, the terminal guard, and the terminal cover are generally covered with the insulator including the insulating portion that covers the inner surface of the terminal guard such that the metal portions are not exposed to the terminal chamber side. Therefore, even if the terminal rod comes out, a live wire portion does not come into contact with a metal surface, which can prevent occurrence of a spark.

In addition, in the hermetic compressor according to one embodiment, the insulating portion that covers the inner surface of the terminal guard is formed integrally with the terminal cover.

According to the above embodiment, since the insulating portion that covers the inner surface of the terminal guard is formed integrally with the terminal cover, for example, by integrally forming the insulating portion and the terminal cover with an insulating resin, it is possible to reduce components costs and assembly costs.

In addition, in the hermetic compressor according to one embodiment, the insulator includes an insulating sheet that covers an area of the compressor shell, the area facing the terminal chamber, and a gap between the insulating portion that covers the inner surface of the terminal guard and the insulating sheet is smaller than the diameter of a terminal rod of the terminal.

According to the above embodiment, the gap between the insulating portion that covers the inner surface of the terminal guard and the insulating sheet that covers the area of the compressor shell, the area facing the terminal chamber, is made smaller than the diameter of the terminal rod of the terminal. Therefore, since the terminal rod that has come out does not enter the gap between the insulating portion and the insulating sheet, the terminal rod does not come into contact with a metal surface deep inside the gap and no spark is generated.

In addition, in the hermetic compressor according to one embodiment, the insulator includes a second insulating portion that covers the body of the terminal.

According to the above embodiment, since the second insulating portion of the insulator covers the body of the terminal, it is possible to prevent the terminal rod that has come out from coming into contact with the body of the terminal, and to reliably prevent occurrence of a spark.

As is clear from the above, according to the present invention, except for at least the body of the terminal, the metal portions facing the terminal chamber are generally covered with the insulator including the insulating portion that covers the inner surface of the terminal guard such that the metal portions are not exposed to the terminal chamber. Therefore, even if the terminal rod comes out, the live wire portion does not come into contact with the metal surface, which can realize a hermetic compressor capable of preventing occurrence of a spark.

DETAILED DESCRIPTION OF EMBODIMENT(S)

Hereinafter, a hermetic compressor of the present invention will be described in detail with reference to the illustrated embodiments.

First Embodiment

Figure 1:
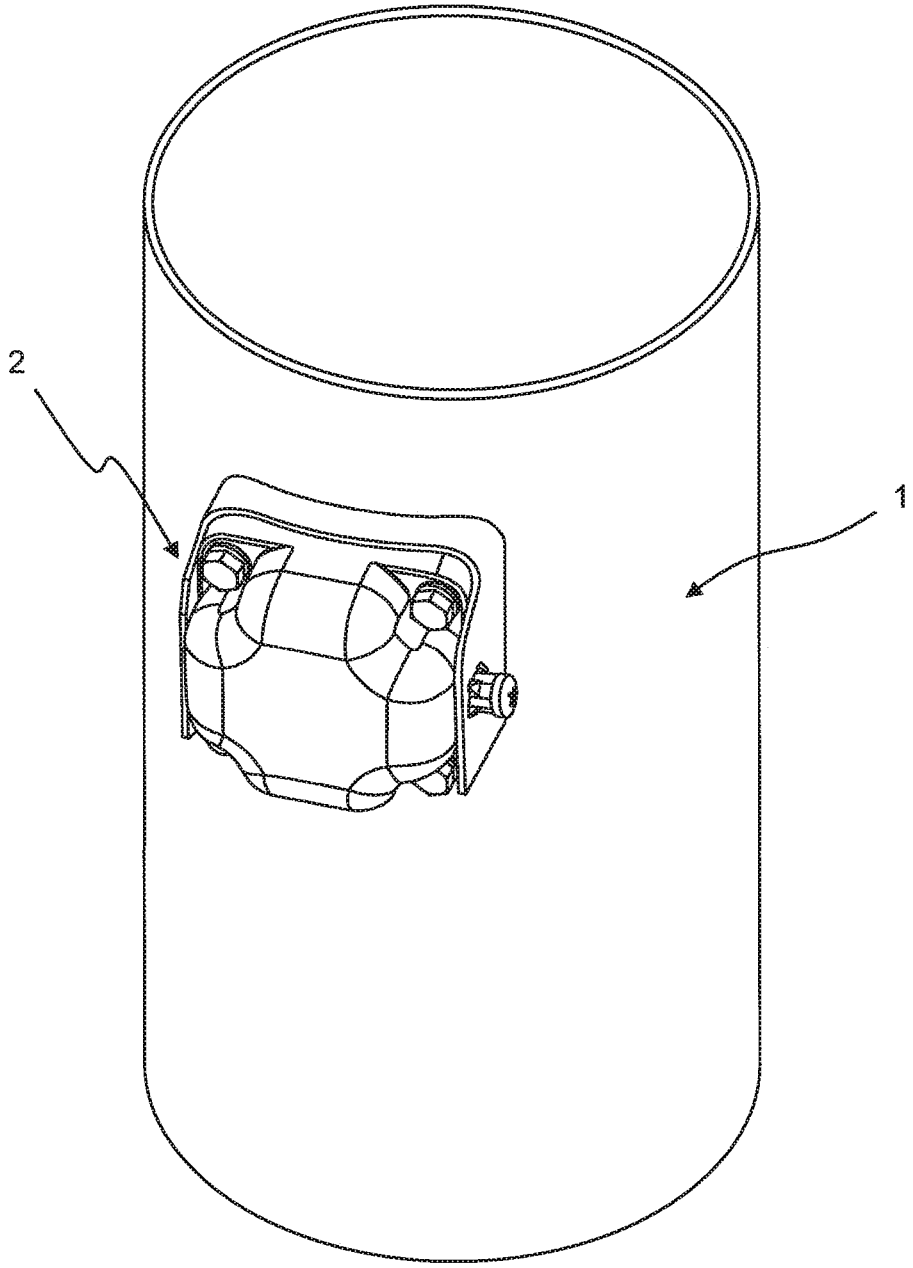
FIG. 1 is a perspective view of a terminal protection structure of a hermetic compressor according to a first embodiment of the present invention.

FIG. 1 is a perspective view of a terminal protection structure 2 of a hermetic compressor according to a first embodiment of the present invention.

As illustrated in FIG. 1, the hermetic compressor according to the first embodiment includes a cylindrical body 1 of a compressor shell and a terminal protection structure 2 provided on the outer peripheral surface of the cylindrical body 1. The terminal protection structure 2 protects a terminal 40 (illustrated in FIG. 3) that protrudes outward from the cylindrical body 1. Here, the terminal 40 is a hermetic terminal (airtight terminal).

The compressor shell (pressure vessel) includes the cylindrical body 1, an upper lid (not illustrated), and a bottom lid (not illustrated). A compression mechanism portion (not illustrated) that compresses a refrigerant is disposed in the compressor shell, and a motor (not illustrated) that drives the compression mechanism portion is disposed below the compression mechanism portion in the compressor shell.

Figure 2:
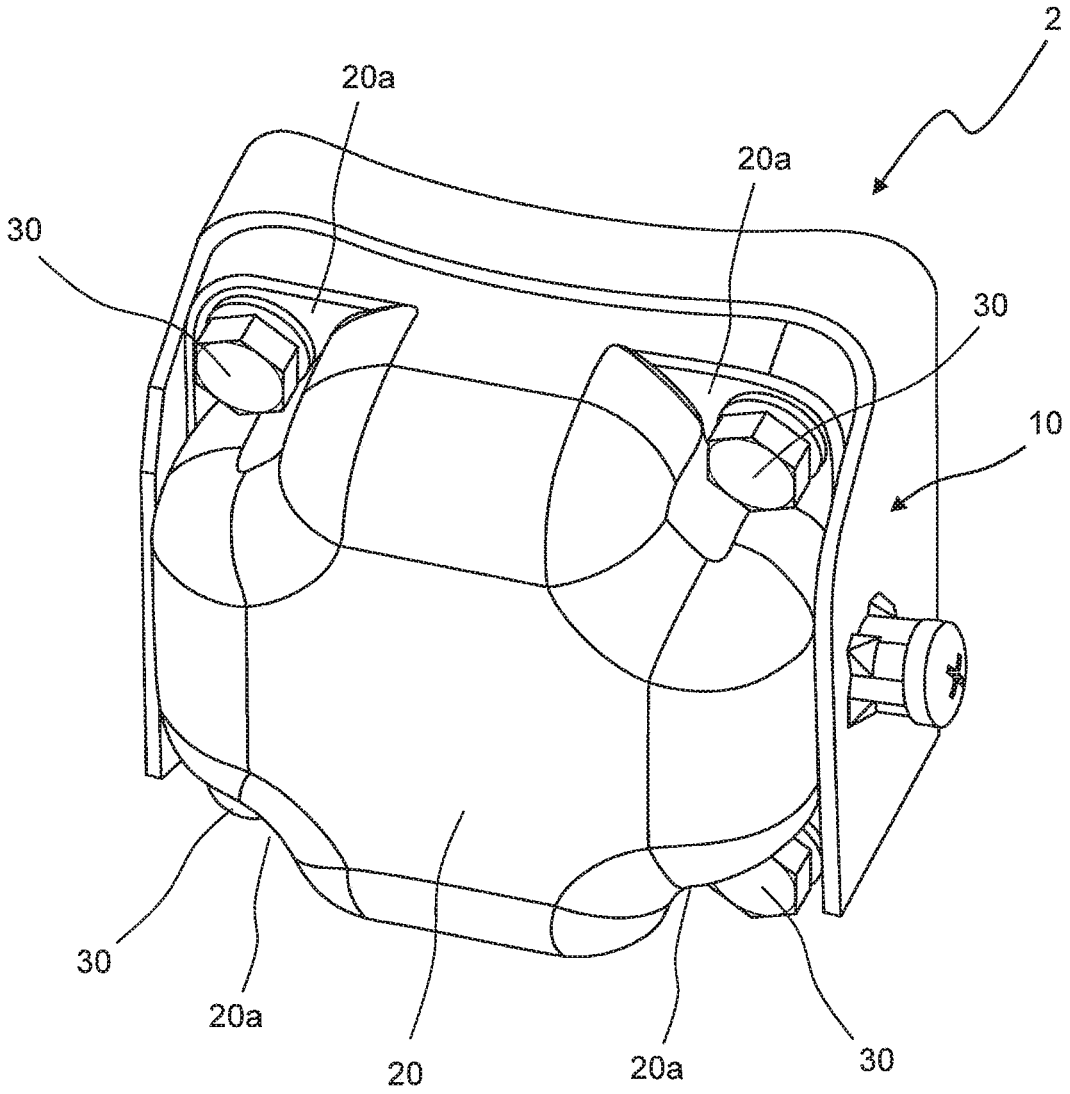
FIG. 2 is a perspective view of the terminal protection structure.

FIG. 2 illustrates a perspective view of the terminal protection structure 2.

As illustrated in FIG. 2, the terminal protection structure 2 includes a terminal guard 10 made of metal, the terminal guard 10 erected on the cylindrical body 1 (illustrated in FIG. 1) so as to surround the terminal 40 (illustrated in FIG. 3) provided on the cylindrical body 1, a terminal cover 20 that has a dome shape and covers the terminal 40, and an insulating sheet 50 (illustrated in FIG. 3) that is disposed at the bottom portion in the terminal guard 10.

The terminal cover 20 is formed of an insulating resin. The terminal cover 20 is mounted such that the opening side of the terminal cover 20 is fitted inside the terminal guard 10.

A concave portion 20*a* recessed inward is provided at each corner portion of the terminal cover 20. A screw 30 for fastening the terminal cover 20 to the terminal guard 10 is disposed in each of the concave portions 20*a* of the terminal cover 20.

Figure 3:
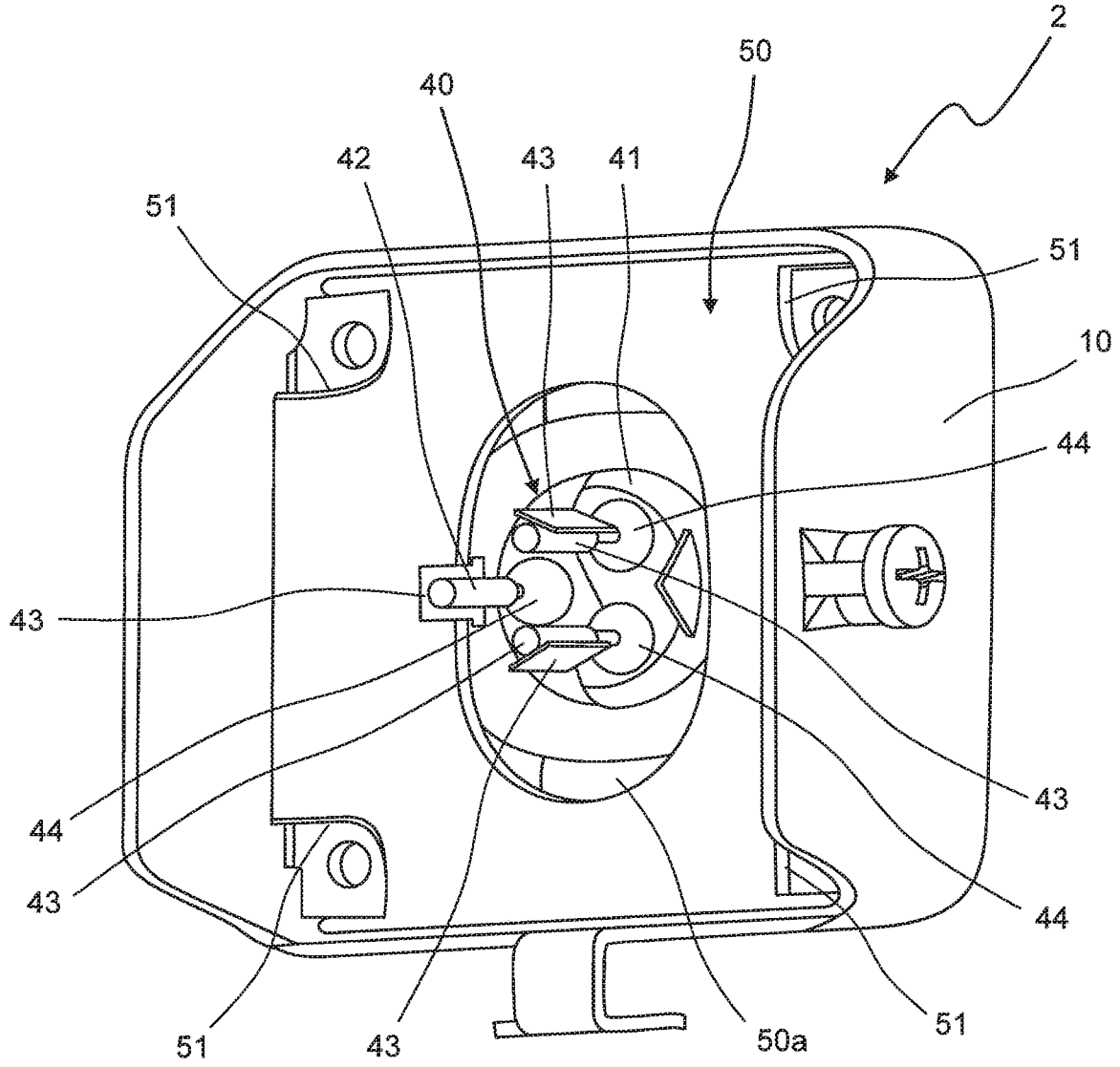
FIG. 3 is a view illustrating a state where a terminal cover of the terminal protection structure is removed.

FIG. 3 illustrates a state where the terminal cover 20 of the terminal protection structure 2 is removed.

As illustrated in FIG. 3, the insulating sheet 50 having a hole 50*a* in a central portion thereof is disposed on the cylindrical body 1 side in the terminal guard 10. A terminal 40 is exposed from the hole 50*a* of the insulating sheet 50. In FIG. 3, 41 denotes a body of the terminal 40, and 42 denotes a terminal rod that penetrates the body 41. A terminal plate 43 for wiring connection is mounted to a front end of the terminal rod 42. In addition, an insulating glass portion 44 insulates the terminal rod 42 from the body 41.

A cutout 51 is provided at each of four corner portions of the insulating sheet 50, in order to pass the screw 30 therethrough.

Figure 4:
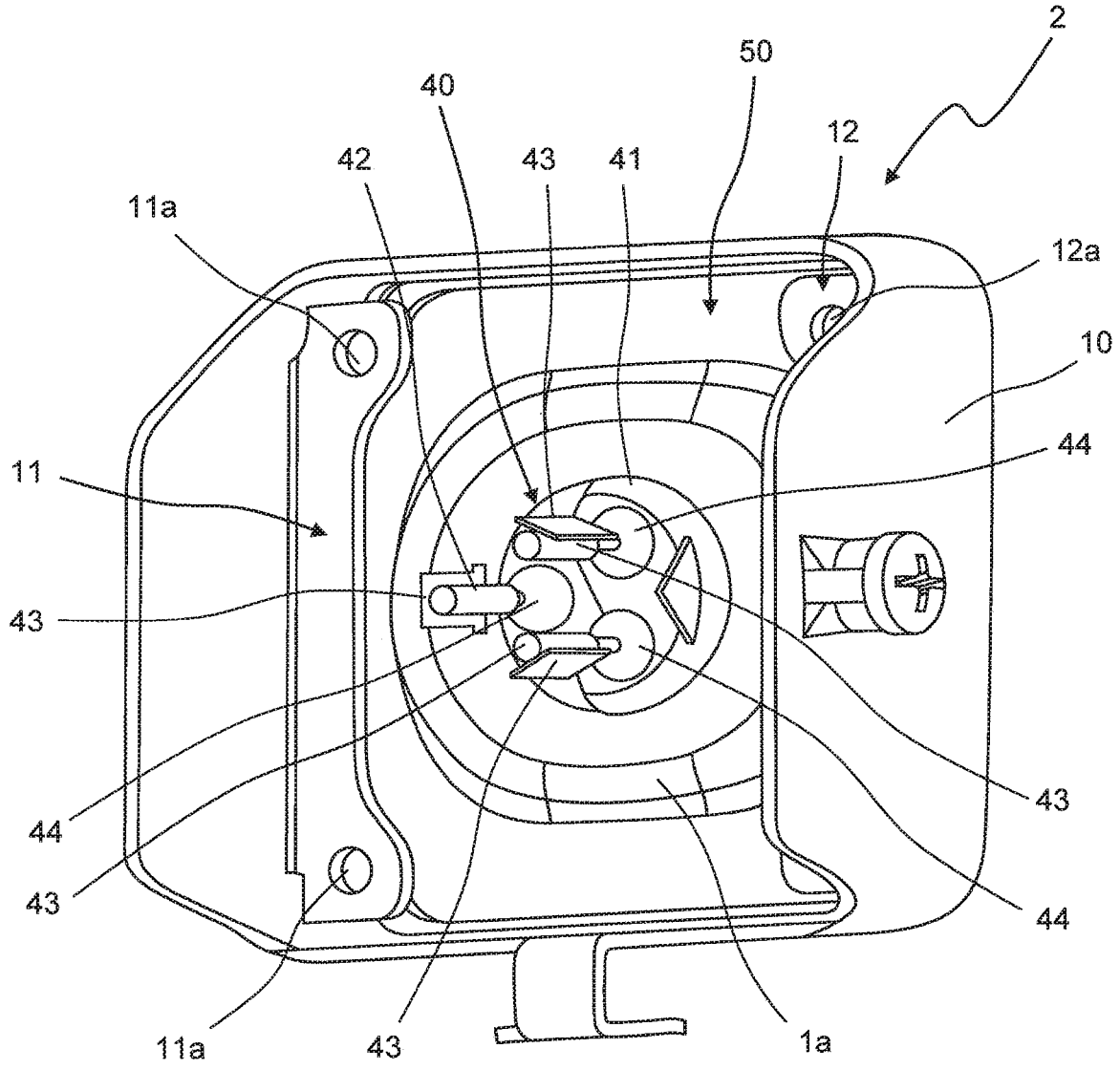
FIG. 4 is a view illustrating a state where the terminal cover and an insulating sheet of the terminal protection structure is removed.

FIG. 4 illustrates a state where the terminal cover 20 and the insulating sheet 50 of the terminal protection structure 2 are removed. In FIG. 4, components identical to those in FIG. 3 are denoted by identical reference signs.

As illustrated in FIG. 4, a projecting portion 1*a* having an elliptic frustum shape and protruding outward is formed on the cylindrical body 1. A terminal 40 is provided in the projecting portion 1*a* of the cylindrical body 1.

Mounting members 11, 12 extending in the vertical direction are provided on the left and right inner wall surfaces of the terminal guard 10, the surfaces facing each other. Screw holes 11*a* are provided at the upper and lower ends of the mounting member 11, respectively. In addition, Screw holes 12*a* are provided at the upper and lower ends of the mounting member 12 (FIG. 4 illustrates only the upper screw hole 12*a*), respectively.

Figure 5:
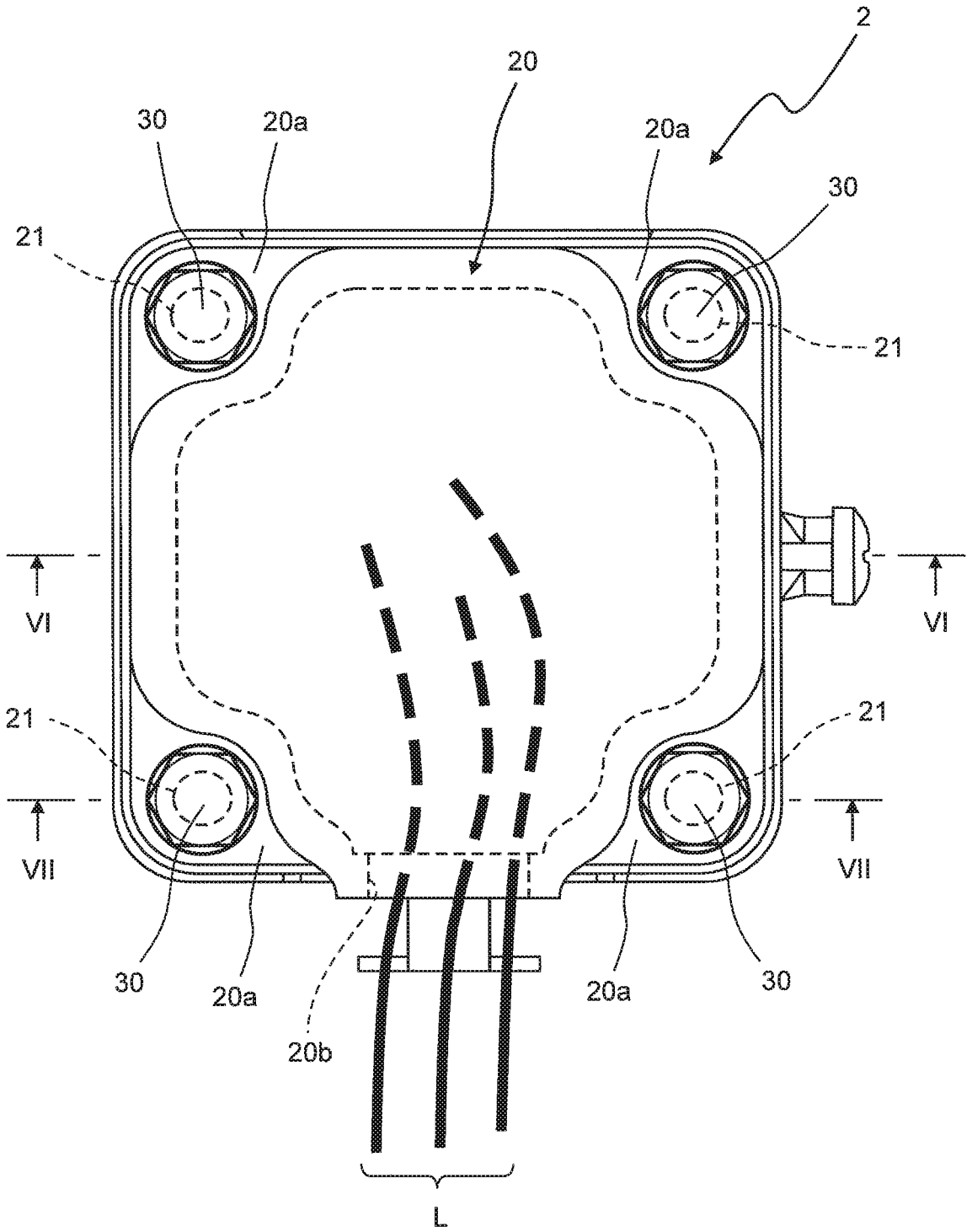
FIG. 5 is a front view of the terminal protection structure.

FIG. 5 illustrates a front view of the terminal protection structure 2. In FIG. 5, components identical to those in FIGS. 3 and 4 are denoted by identical reference signs.

As illustrated in FIG. 5, the terminal cover 20 has circular holes 21 through which the screws 30 is inserted in the concave portions 20*a* provided in the corner portions, respectively.

In FIG. 5, L indicates lead wires whose one ends are connected to the terminal plates 43 of the terminal 40 illustrated in FIGS. 2 and 3, respectively. The lead wires L are drawn out through a cutout 20*b* provided on the lower side of the terminal cover 20.

Figure 6:
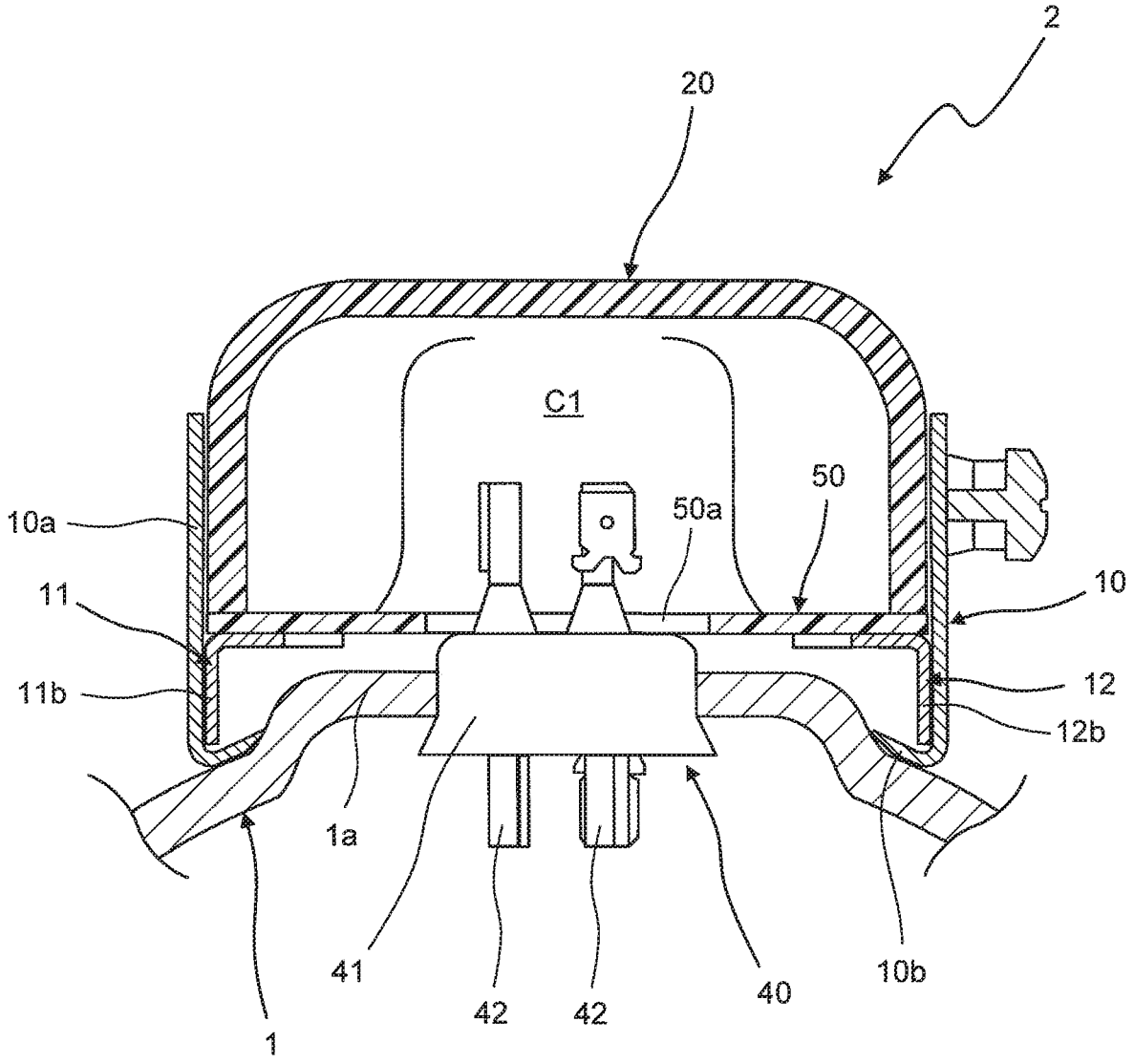
FIG. 6 is a cross-sectional view taken along line VI-VI in FIG. 5.

FIG. 6 illustrates a cross-sectional view taken along line VI-VI in FIG. 5. In FIG. 6, components identical to those in FIGS. 3 to 5 are denoted by identical reference signs.

As illustrated in FIG. 6, a terminal chamber C1 is defined by the cylindrical body 1, the terminal guard 10, and the terminal cover 20. Except for at least the body 41 of the terminal 40, the metal portions facing the terminal chamber C1 are generally covered by the terminal cover 20 and the insulating sheet 50 so as not to be exposed to the terminal chamber C1.

The terminal guard 10 includes a terminal guard body 10*a* that surrounds the terminal 40, and a bent portion 10*b* that bends inward from the lower end of the terminal guard body 10*a* and that is brought into contact with the cylindrical body 1. The bent portion 10*b* of the terminal guard 10 is fixed to the cylindrical body 1 by welding.

The mounting member 11 in the terminal guard 10 has a bent portion 11*b* bent toward the cylindrical body 1, and the bent portion 11*b* is fixed to the inner wall surface of the terminal guard 10 by welding. Similarly, the mounting member 12 in the terminal guard 10 has a bent portion 12*b* bent toward the cylindrical body 1, and the bent portion 12*b* is fixed to the inner wall surface of the terminal guard 10 by welding.

Figure 7:
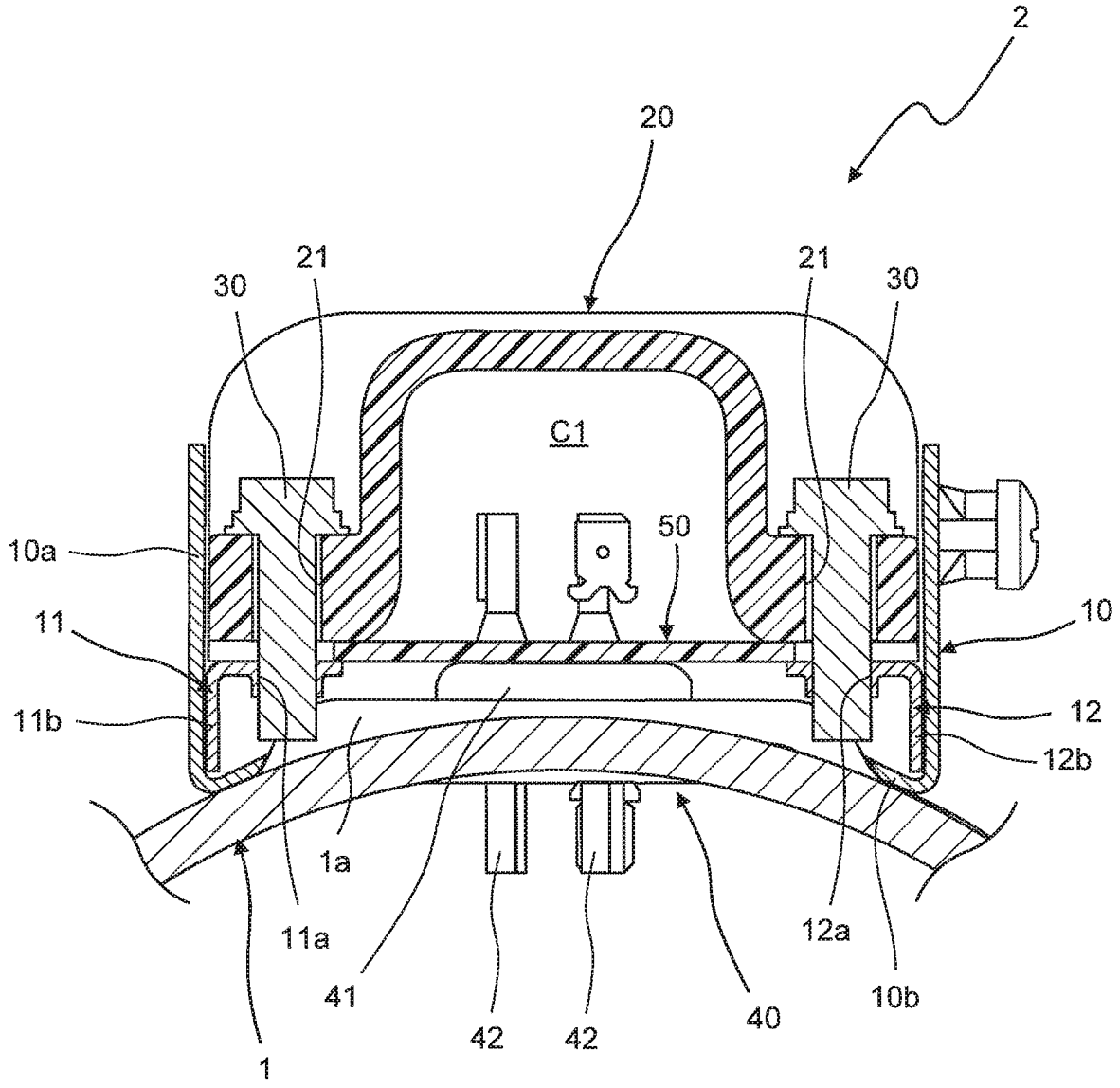
FIG. 7 is a cross-sectional view taken along line VII-VII in FIG. 5.

FIG. 7 illustrates a cross-sectional view taken along line VII-VII in FIG. 5. In FIG. 7, components identical to those in FIGS. 3 to 5 are denoted by identical reference signs.

As illustrated in FIG. 7, by inserting screws 30 into the four circular holes 21 of the terminal cover 20 and screwing the screws 30 into the screw holes 11*a*, 12*a* of the mounting member 11 of the terminal guard 10, the terminal cover 20 is mounted to the terminal guard 10.

According to the hermetic compressor configured as described above, except for at least the body 41 of the terminal 40, the metal portions facing the terminal chamber C1 defined by the body 1 of the compressor shell, the terminal guard 10, and the terminal cover 20 are generally covered by the insulating terminal cover 20 and the insulating sheet 50 so as not to be exposed to the terminal chamber C1. Therefore, even if the terminal rod 42 comes out, the live wire portion does not come into contact with the metal surfaces of the cylindrical body 1 and the terminal guard 10, and it is possible to prevent occurrence of a spark. Here, the live wire portion is the terminal rod 42 and the terminal plate 43 to which a high voltage is applied.

The terminal cover 20 and the insulating sheet 50 constitute an insulator including an insulating portion that covers the inner surface of the terminal guard 10.

The insulating portion that covers the inner surface of the terminal guard 10 and the terminal cover 20 are formed of an insulating resin and integrally molded. As a result, component costs and assembly costs can be reduced.

A gap between the terminal cover 20 (including the insulating portion that covers the inner surface of the terminal guard 10) and the insulating sheet 50 that covers an area of the cylindrical body 1, the area facing the terminal chamber C1, is smaller than the diameter of the terminal rod 42 of the terminal 40. As a result, the terminal rod 42 that has come out does not enter the gap between the terminal cover 20 and the insulating sheet 50. Therefore, the terminal rod 42 does not come into contact with the metal surfaces of the cylindrical body 1 and the terminal guard 10, and no spark occurs.

In the first embodiment, the body 41 of the terminal 40 is not covered with an insulator. However, when the terminal rod 42 comes out, a refrigerant or the like is vigorously jetted from the inside of the hermetic compressor. Therefore, a situation is unlikely to occur in which the terminal rod 42 is brought into contact with the body 41 of the terminal 40.

Figure 8:
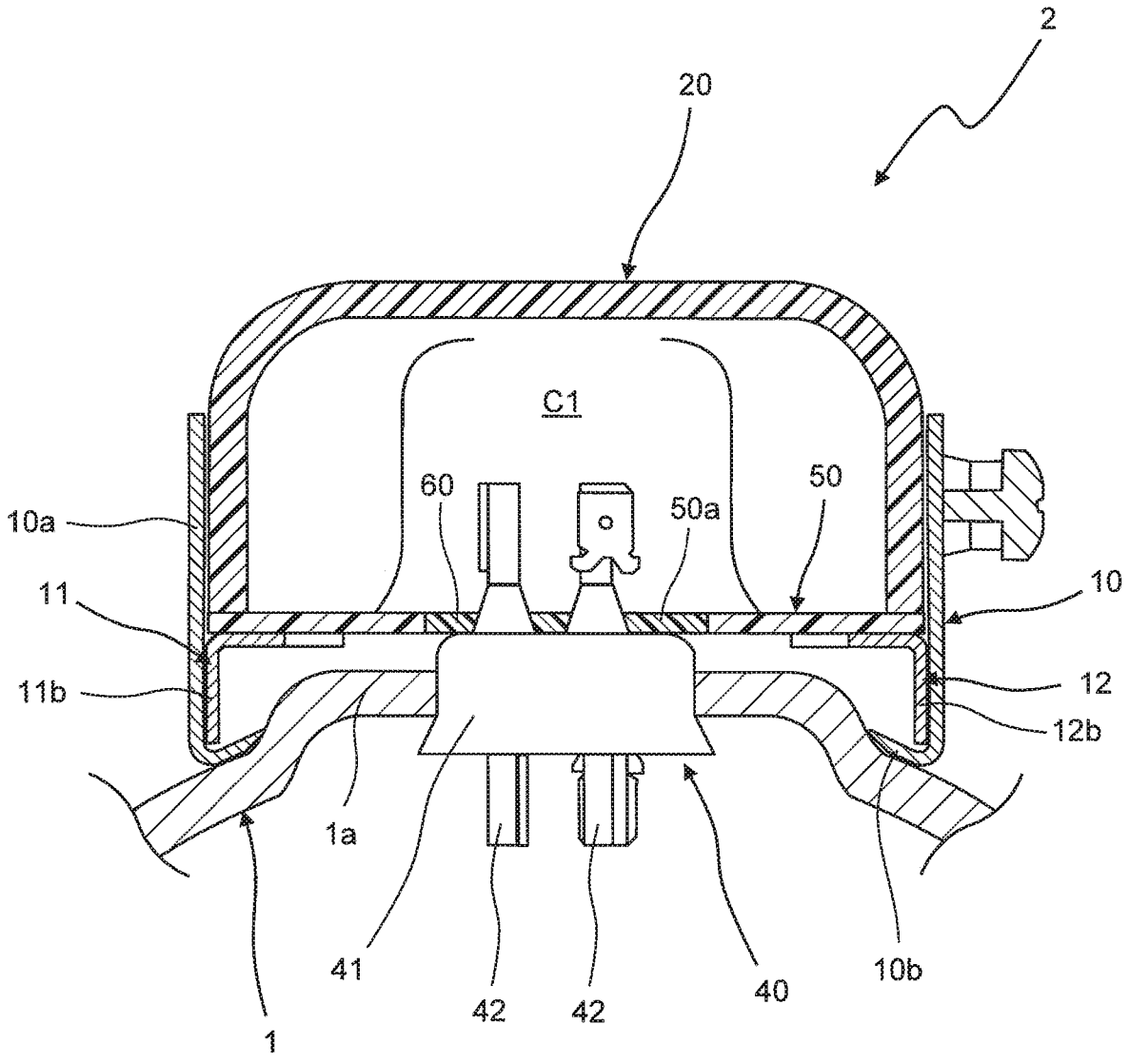
FIG. 8 is a cross-sectional view illustrating a modification of the first embodiment.

Note that, for example, a second insulating portion 60 that covers the hole 50*a* of the insulating sheet 50 may be provided separately as illustrated in FIG. 8. In addition, for example, an insulating sheet that covers the entire bottom portion (excluding the terminal rods 42 and the terminal plates 43) in the terminal guard 10 may be provided.

Second Embodiment

Figure 9:
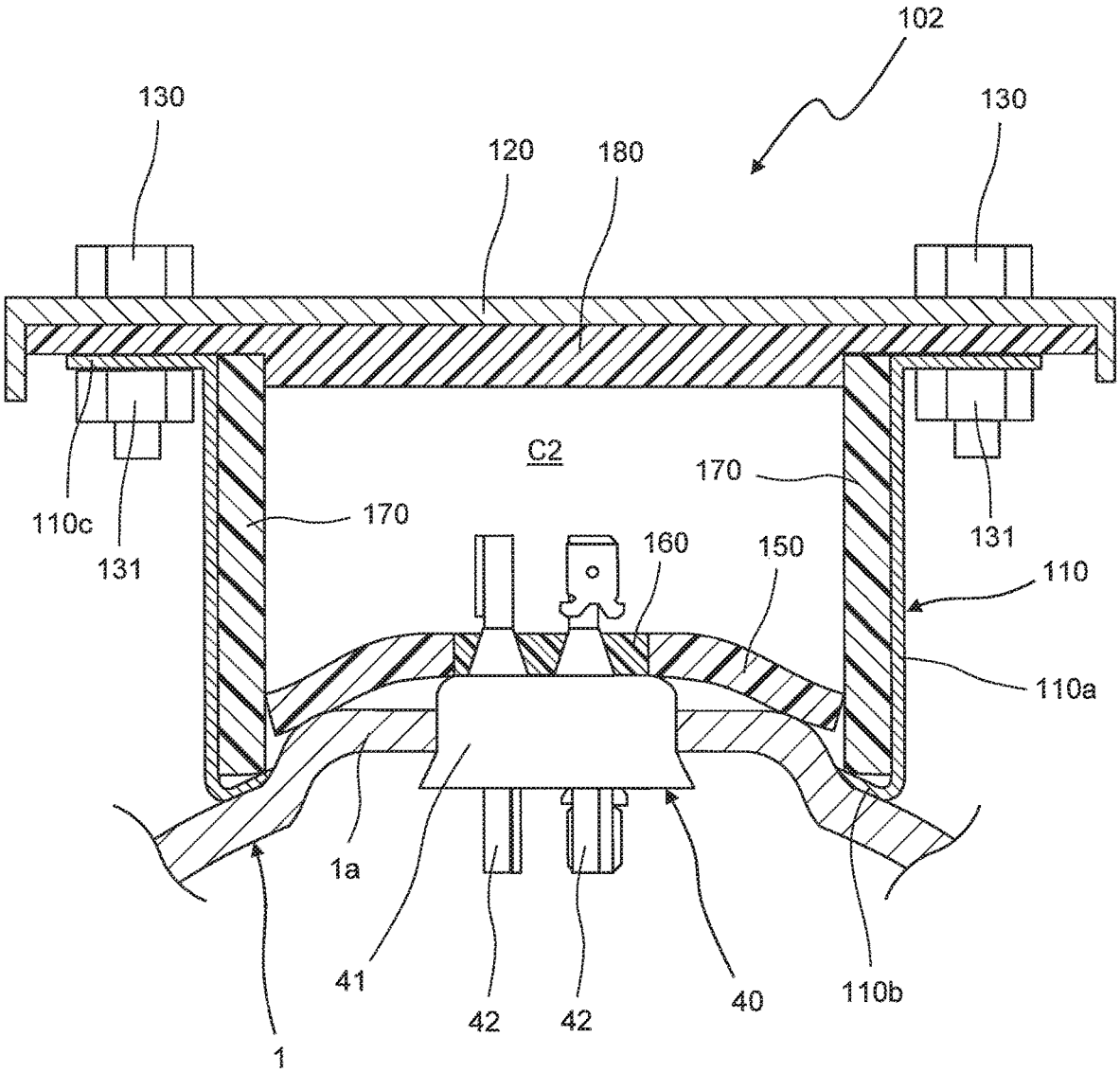
FIG. 9 is a cross-sectional view of a terminal protection structure of a hermetic compressor according to a second embodiment of the present invention.

FIG. 9 is a cross-sectional view of a terminal protection structure 102 of a hermetic compressor according to a second embodiment of the present invention. The hermetic compressor according to the second embodiment has the configuration identical to the configuration of the hermetic compressor according to the first embodiment except for a terminal protection structure 102.

As illustrated in FIG. 9, the terminal protection structure 2 includes a terminal guard 110 made of metal, the terminal guard 110 erected on a cylindrical body 1 so as to surround a terminal 40 provided on the cylindrical body 1, a terminal cover 120 that is made of metal and that covers the terminal 40, an insulating sheet 150 disposed at the bottom portion in the terminal guard 110, a first insulating portion 170 that covers the inner surface of a terminal guard body 110*a*, a second insulating portion 160 that covers a body 41 of the terminal 40, and a third insulating portion 180 that covers the lower-surface side of the terminal cover 120.

The terminal guard 110 includes a terminal guard body 110*a* that surrounds the terminal 40, a bent portion 110*b* that bends inward from the lower end of the terminal guard body 110*a* and is brought into contact with the cylindrical body 1, and a flange 110*c* that bends and extends outward from the upper end of the terminal guard body 110*a*.

The terminal cover 120 is mounted to the terminal guard 110 with bolts 130 and nuts 131, in a state where the flange 110*c* of the terminal guard 110 and the terminal cover 120 sandwich the third insulating portion 180 therebetween.

The insulating sheet 150, the first insulating portion 170, the second insulating portion 160, and the third insulating portion 180 constitute an insulator.

According to the hermetic compressor configured as described above, the metal portions facing a terminal chamber C2 defined by the cylindrical body 1 of a compressor shell, the terminal guard 110, and the terminal cover 120 are covered with the insulating sheet 150, the first insulating portion 170, the second insulating portion 160, and the third insulating portion 180 so as not to be exposed to the terminal chamber C2. As a result, even if a terminal rod 42 comes out, it is possible to prevent a live wire portion from coming into contact with metal surfaces of the cylindrical body 1, the terminal guard 110, and the terminal cover 120, and to prevent occurrence of a spark.

In addition, since the second insulating portion 160 covers the body 41 of the terminal 40, it is possible to prevent the terminal rod 42 that has come out from coming into contact with the body 41 of the terminal 40, and to reliably prevent occurrence of a spark.

The hermetic compressor according to the second embodiment has effects similar to those of the hermetic compressor according to the first embodiment.

Third Embodiment

A hermetic compressor according to a third embodiment of the present invention has a configuration identical to the configuration of the hermetic compressor according to the second embodiment except for part of a terminal protection structure, and will be described with reference to FIG. 9.

In the hermetic compressor according to the second embodiment, the insulating sheet 150 and the second insulating portion 160 that covers the body 41 of the terminal 40 are disposed at the bottom portion in the terminal guard 110. In contrast, in the hermetic compressor according to the third embodiment, an insulating sheet integrated with a second insulating portion that covers a body 41 of a terminal 40 is disposed on a cylindrical body 1 side in a terminal guard 10.

The hermetic compressor according to the third embodiment has effects similar to those of the hermetic compressor according to the second embodiment.

Although specific embodiments of the present invention have been described, the present invention is not limited to the first to third embodiments, and various modifications can be made within the scope of the present invention.

For example, examples of a hermetic compressor to which the present invention is applied include a scroll compressor, a rotary compressor, a swing compressor, and the like. That is, the present invention can be applied to various types of compressors.

What is claimed is:

1. A hermetic compressor comprising:

a compressor shell;

a terminal provided on the compressor shell;

a terminal guard erected on the compressor shell and surrounding the terminal; and a terminal cover mounted to the terminal guard and covering the terminal, a terminal chamber being defined by the compressor shell, the terminal guard, and the terminal cover, except for at least a body of the terminal, metal portions facing the terminal chamber being generally covered with an insulator such that the metal portions are not exposed to the terminal chamber, the insulator including an insulating portion that covers an inner surface of the terminal guard, the insulator including an insulating sheet covering an area of the compressor shell, the area facing the terminal chamber, and the insulating sheet having a part disposed between a mounting member provided on the inner surface of the terminal guard and the terminal cover, the insulating sheet being spaced from the compressor shell.

2. The hermetic compressor according to claim wherein the insulating portion is formed integrally with the terminal cover.

3. The hermetic compressor according to claim 1, wherein a gap between the insulating portion and the insulating sheet is smaller than a diameter of a terminal rod of the terminal.

4. The hermetic compressor according to claim wherein the insulator includes a second insulating portion that covers the body of the terminal.

5. The hermetic compressor according to claim 2, wherein a gap between the insulating portion and the insulating sheet is smaller than a diameter of a terminal rod of the terminal.

6. The hermetic compressor according to claim 5, wherein the insulator includes a second insulating portion that covers the body of the terminal.

7. The hermetic compressor according to claim 2, wherein the insulator includes a second insulating portion that overs the body of the terminal.

8. The hermetic compressor according to claim 3, wherein the insulator includes a second insulating portion that covers the body of the terminal.

* * * * *